US010413479B2

(12) United States Patent
Green

(10) Patent No.: US 10,413,479 B2
(45) Date of Patent: Sep. 17, 2019

(54) PRESSURE POINT SLEEP GARMENT

(71) Applicant: Carrie Green, Naples, FL (US)

(72) Inventor: Carrie Green, Naples, FL (US)

( * ) Notice: Subject to any disclaimer, the term of this patent is extended or adjusted under 35 U.S.C. 154(b) by 284 days.

(21) Appl. No.: 15/440,328

(22) Filed: Feb. 23, 2017

(65) Prior Publication Data

US 2018/0235836 A1 Aug. 23, 2018

(51) Int. Cl.
*A61H 39/04* (2006.01)
*A41B 11/04* (2006.01)

(52) U.S. Cl.
CPC ..... *A61H 39/04* (2013.01); *A41B 11/04* (2013.01); *A41B 2400/32* (2013.01); *A61H 2201/1642* (2013.01); *A61H 2201/1645* (2013.01); *A61H 2205/12* (2013.01)

(58) Field of Classification Search
CPC ..... A41B 11/007; A41B 11/02; A41B 11/04; A41B 11/125; A41B 11/126; A41B 2400/32; A41B 2400/322; A61H 2201/164; A61H 2201/1642; A61H 2201/1645; A61H 2201/165; A61H 2201/1652; A61H 2205/12; A61H 2205/125; A61H 39/04
See application file for complete search history.

(56) References Cited

U.S. PATENT DOCUMENTS 2,734,286 A * 2/1956 Anson ..... A43B 7/146 36/11.5
3,496,944 A * 2/1970 Cuozzi ..... A41B 11/126 2/407
4,651,354 A * 3/1987 Petrey ..... A41B 11/004 2/239
4,694,831 A 9/1987 Seltzer
4,823,799 A * 4/1989 Robbins ..... A43B 7/146 36/129
5,553,398 A 9/1996 Schnewlin-Maier
5,584,854 A * 12/1996 Minarik ..... A61H 39/04 606/201
5,667,484 A * 9/1997 Brossard ..... A43B 7/146 602/21
5,769,803 A * 6/1998 Brossard ..... A43B 7/146 600/507
5,769,810 A * 6/1998 Brossard ..... A43B 7/146 600/557
6,138,281 A * 10/2000 Chiaruttini ..... A41B 11/00 2/239
6,314,584 B1 * 11/2001 Errera ..... A41B 11/008 2/239

(Continued)

FOREIGN PATENT DOCUMENTS

CN 201657773 U 12/2010

OTHER PUBLICATIONS

"Best Plantar Fasciitis Socks and Compression Sleeves." Plantar Fasciitis Resource. N.p., Jul. 24, 2015. Web. Feb. 23, 2017. <http://www.plantarfasciitisresource.com/best-plantar-fasciitis-socks/>.

(Continued)

*Primary Examiner* — Ryan J. Severson
(74) *Attorney, Agent, or Firm* — Mark Terry

(57) ABSTRACT

A pressure point sleep garment (1) used to apply a constant concentrated pressure to a heel (4) of a wearer to induce sleep and alleviate insomnia wherein a projection (15) is pressed upward into the heel of the wearer via a sock (5) and/or one or more straps (17).

6 Claims, 4 Drawing Sheets

(56) References Cited

U.S. PATENT DOCUMENTS

| | | | | |
|---|---|---|---|---|
| 6,324,874 | B2 | 12/2001 | Fujimoto | |
| 6,527,792 | B1 * | 3/2003 | Todd | A43B 7/146 606/204 |
| 6,673,421 | B1 * | 1/2004 | Andrews | A41B 11/04 2/239 |
| 7,192,411 | B2 | 3/2007 | Gobet et al. | |
| 7,346,936 | B2 * | 3/2008 | Vargas | A41B 11/02 2/239 |
| 7,552,483 | B2 * | 6/2009 | Turner | A41B 11/125 2/239 |
| 7,572,241 | B2 | 8/2009 | Slautterback et al. | |
| 8,241,232 | B2 * | 8/2012 | Sanders | A61H 1/0266 36/11.5 |
| 8,308,665 | B2 * | 11/2012 | Harry | A43B 3/0005 601/22 |
| 9,675,119 | B2 * | 6/2017 | Alston | A41B 11/007 |
| 10,021,919 | B2 * | 7/2018 | Spicuzza | A41B 11/007 |
| 2004/0173220 | A1 * | 9/2004 | Harry | A43B 3/0005 128/892 |
| 2005/0172379 | A1 * | 8/2005 | Bush | A41B 11/125 2/123 |
| 2006/0026740 | A1 * | 2/2006 | Vargas | A41B 11/02 2/239 |
| 2006/0206987 | A1 * | 9/2006 | Turner | A41B 11/125 2/239 |
| 2008/0189829 | A1 * | 8/2008 | Fusco | A61F 5/30 2/239 |
| 2009/0013450 | A1 * | 1/2009 | Lambertz | A41B 11/003 2/239 |
| 2010/0005567 | A1 * | 1/2010 | Nisimov | A41B 11/125 2/240 |
| 2010/0050322 | A1 * | 3/2010 | Zagula | A41B 11/006 2/239 |
| 2010/0081984 | A1 * | 4/2010 | Coffinardi | A41B 11/126 602/63 |
| 2011/0054368 | A1 * | 3/2011 | Sanders | A61H 1/0266 601/118 |
| 2012/0117702 | A1 * | 5/2012 | King | A41B 17/005 2/2.16 |
| 2013/0145521 | A1 * | 6/2013 | Spicuzza | A41B 11/007 2/239 |
| 2014/0041099 | A1 * | 2/2014 | Boyd | A41B 11/125 2/239 |
| 2014/0230131 | A1 | 8/2014 | Alston | |
| 2014/0331386 | A1 * | 11/2014 | Taylor | A41B 11/00 2/239 |
| 2016/0000177 | A1 * | 1/2016 | Barkol | A43B 7/146 2/239 |
| 2016/0287472 | A1 * | 10/2016 | Starzhynskaya | A61H 39/04 |
| 2016/0331070 | A1 * | 11/2016 | Williams P.D.M. | A43B 7/146 |
| 2017/0258146 | A1 * | 9/2017 | Haynes | A41B 11/125 |
| 2018/0235836 | A1 * | 8/2018 | Green | A61H 39/04 |
| 2018/0310636 | A1 * | 11/2018 | Kettenbach | A41B 11/00 |
| 2019/0038505 | A1 * | 2/2019 | Wedemeyer | A61H 39/04 |

OTHER PUBLICATIONS

Seth, Radhika. "Just the Right Pressure." Yanko Design. N.p., May 8, 2012. Web. Feb. 23, 2017. <http://www.yankodesign.com/2012/05/08/just-the-right-pressure/>.

* cited by examiner

PRESSURE POINT SLEEP GARMENT

FIELD OF THE INVENTION

This invention relates to sleep aids and more particularly a garment used to apply a constant concentrated pressure to a heel of a wearer to induce sleep and alleviate insomnia.

BACKGROUND OF THE INVENTION

Many individuals experience insomnia-like symptoms that include waking without feeling refreshed, having trouble staying asleep and not being able to fall asleep quickly.

The shimien pressure point is known as the insomnia pressure point and is found on the bottom of the foot on the heel. Applying physical pressure to the shimien pressure point is known to relax an individual and alleviate insomnia. However, although physical pressure can be applied by the individual rubbing his or her own feet or having another person rub his or her own feet, such does not provide a constant concentrated pressure being applied to the shimien pressure point throughout the night.

Therefore, a need exists for a garment used to apply a constant concentrated pressure to a heel of a wearer to induce sleep and alleviate insomnia.

The relevant prior art includes the following references:

| Pat. No. (U.S. patent References) | Inventor | Issue/Publication Date |
|---|---|---|
| 6,324,874 | Fujimoto | Dec. 4, 2001 |
| 2014/0230131 | Alston | Aug. 21, 2014 |
| 7,572,241 | Slautterback et al. | Aug. 11, 2009 |
| 7,192,411 | Gobet et al. | Mar. 20, 2007 |
| 4,694,831 | Seltzer | Sep. 22, 1987 |
| 5,553,398 | Schnewlin-Maier | Sep. 10, 1996 |
| (Foreign Patent References) | | |
| CN201657773 | N/A | Dec. 1, 2010 |
| (Non-Patent Literature) | | |

http://www.plantarfasciitisresource.com/best-plantar-fasciitis-socks/
http://www.yankodesign.com/2012/05/08/just-the-right-pressure/

SUMMARY OF THE INVENTION

The primary object of the present invention is to provide a garment used to apply a constant concentrated pressure to a heel of a wearer to induce sleep and alleviate insomnia.

The present invention fulfills the above and other objects by providing a sock having a projection located in a heel portion thereof that applies pressure to the shimien, which is the pressure point located on the heel of an individual's foot, to alleviate insomnia.

The projection may be integrated into the fabric of the sock by being sewn onto the fabric, woven into the fabric, adhered to the fabric or so forth in a position that is permanent.

The projection may also be attached to the sock via one or more straps secured to an upper portion of the sock. The one or more straps allow the projection to be moved into various positions. For example, the projection may be positioned under the wearer's heel when the wearer is lying down or pulled back behind the heel when the wearer needs to walk, thereby allowing the wearer to walk without the projection being located on the bottom of the foot. In addition, the one or more straps allow the projection to be tightened or loosened against the heel of the wearer via at least one length adjusting mechanism, such as a slide. Non-slip material, such as silicone, may be located on an interior surface of the sock to hold the sock in position on the wearer's foot.

Alternatively, the projection may be secured to one or more straps that are worn without a sock, under a sock and/or over a sock. The one or more straps preferably create a loop that encircles the ankle of the wearer's foot and has a strap that extends downward under the heel of the wearer's foot and holds the projection against the heel.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 2:
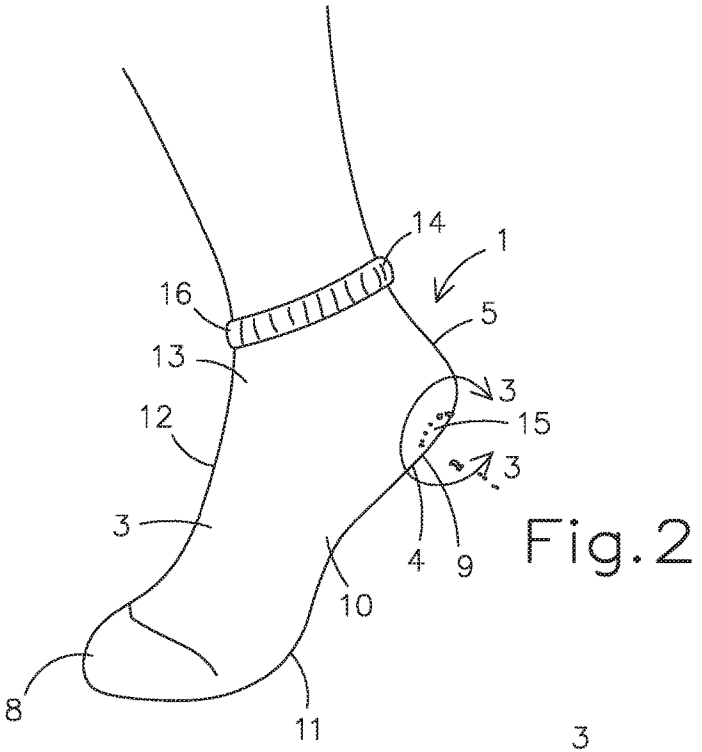
FIG. 2 is a side view of a pressure point sleep garment of the present invention being worn on a foot as a sock.

For purposes of describing the preferred embodiment, the terminology used in reference to the numbered accessories in the drawings is as follows:

1. pressure point sleep garment, generally
2. shimien pressure point
3. foot
4. heel
5. sock
6. interior surface of sock
7. exterior surface of sock
8. toe of sock
9. heel of sock
10. arch of sock
11. bottom surface of sock
12. top surface of sock
13. upper portion of sock
14. cuff of sock
15. projection
16. non-slip material
17. strap
18. slide
19. ankle strap

20. ankle

21. heel strap

Figure 1:
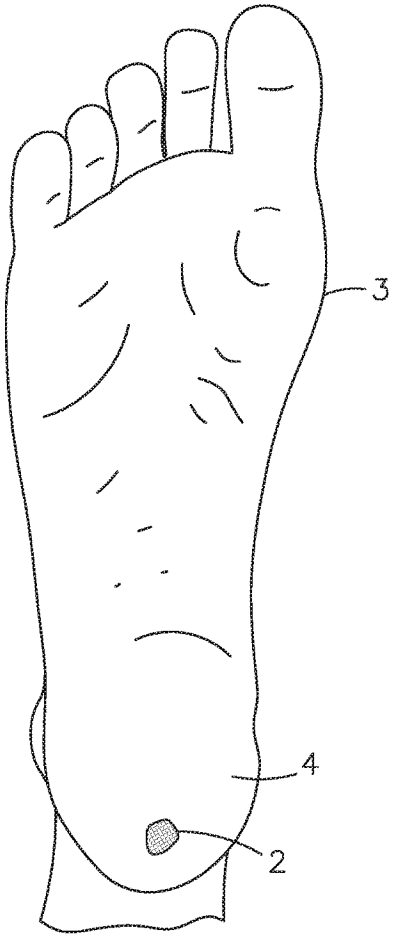
FIG. 1 is bottom view of a foot 3 showing the location of the shimien pressure point.

With reference to FIG. 1, a bottom view of a foot 3 showing the location of the shimien pressure point 2 is illustrated. The shimien pressure point 2 is known as the "insomnia pressure point" and is found on the bottom of the foot 3 near the center of the heel 4.

Figure 3:
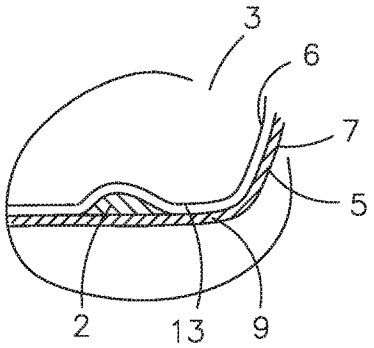
FIG. 3 is a partial cross sectional view along line 3-3 of FIG. 2 of a pressure point sleep garment of the present invention being worn on a foot as a sock.

With reference to FIGS. 2 and 3, a side view and a partial cross sectional view along line 3-3 of FIG. 2, respectively, of a pressure point sleep garment 1 of the present invention being worn on a foot 3 is illustrated. The pressure point sleep garment 1 of the present invention comprises a tubular-shaped sock 5 having an interior surface 6, an exterior surface 7, a toe 8, a heel 9, an arch 10, a bottom surface 11, a top surface 12, an upper portion 13 and a cuff 14. A projection is located on the heel 9 in a position that places the projection 15 under the shimien pressure point 2 when the pressure point sleep garment 1 is worn on a wearer's foot 3. The projection 15 may be integrated into fabric of the pressure point sleep garment 1 by being sewn onto the fabric, woven into the fabric, adhered to the fabric, or so forth.

The projection 15 extends upward from the interior surface 6 a predetermined distance so that when the pressure point sleep garment 1 is stretched over the foot 3 the projection 15 will apply pressure to the shimien pressure point 2 to help insomnia. As illustrated here the projection 15 is spherically-shaped, however, the projection 15 may be any other geometric shape that extends upward and applies a concentrated pressure on the shimien pressure point 2.

Non-slip material 16, such as silicone, may be located on the interior surface 6 or on the 13 of the pressure point sleep garment 1 to hold the pressure point sleep garment 1 in position on the wearer's foot 3, which in turn maintains a constant concentrated pressure on the shimien pressure point 2 by the projection 15. Alternatively, the cuff 14 may have an elastic and/or adjustable strap to tighten the cuff in place on above the wearer's foot 3.

Figure 4:
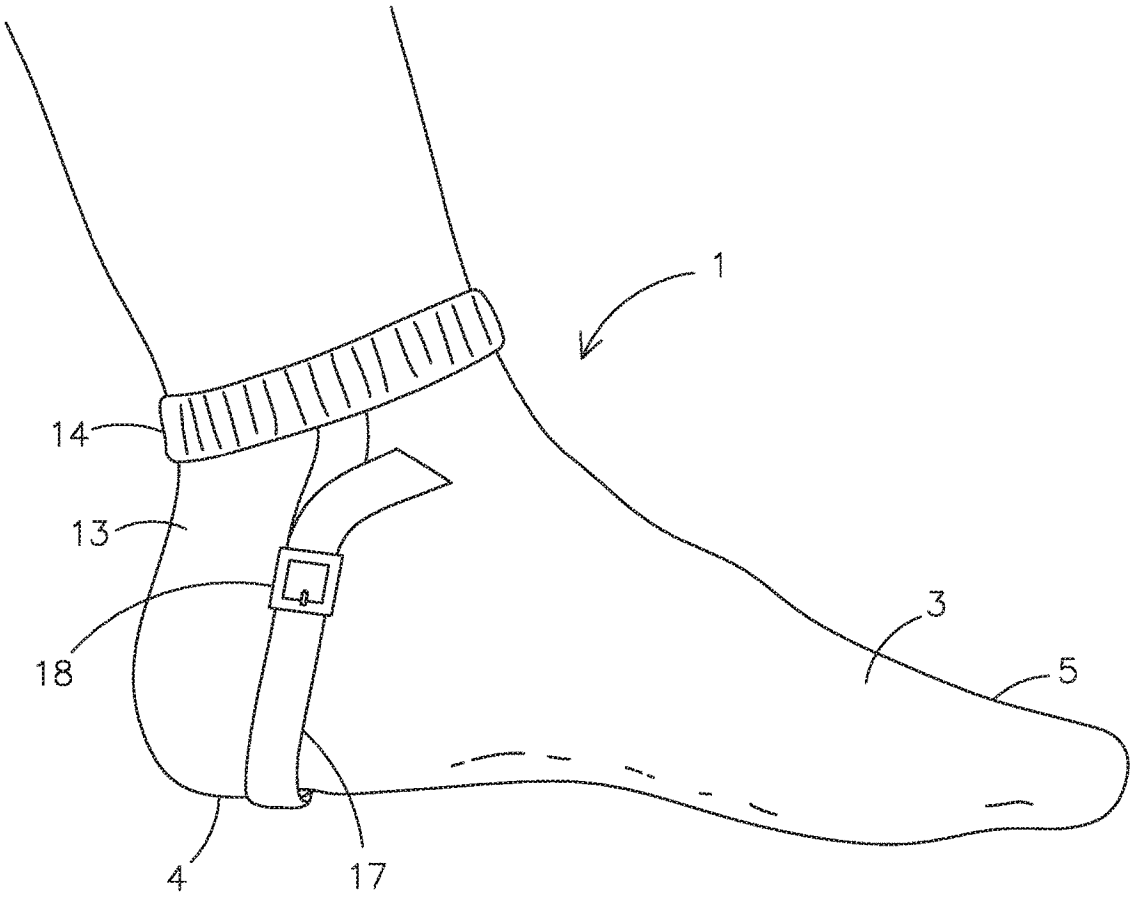
FIG. 4 is a side view of a pressure point sleep garment of the present invention being worn on a foot wherein the projection is placed directly under the heel via a strap.
Figure 5:
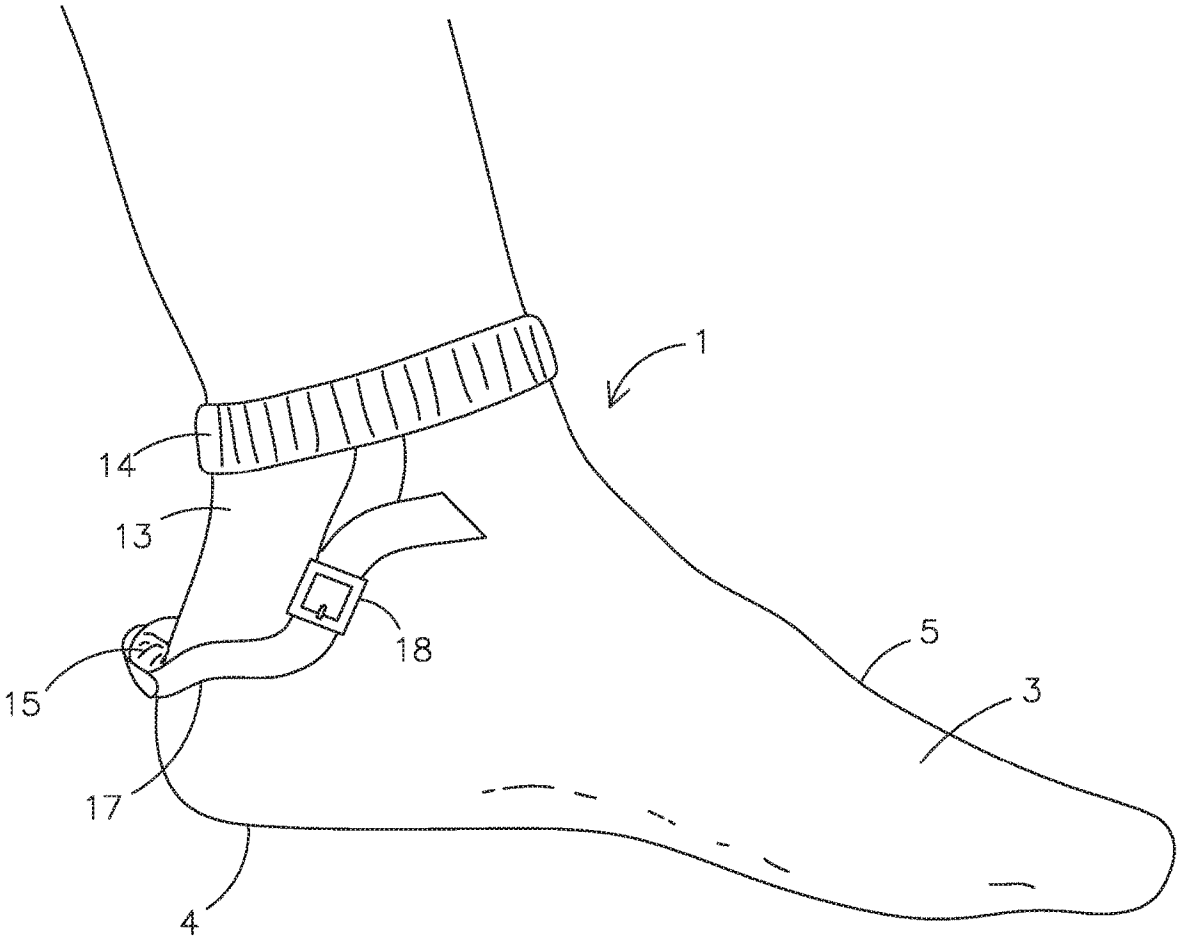
FIG. 5 is a side view of a pressure point sleep garment of the present invention being worn on a foot wherein the projection is placed behind the heel via a strap.

With reference to FIGS. 4 and 5, side views of a pressure point sleep garment 1 of the present invention being worn on a foot 3 wherein the projection 15 is placed directly under the heel 4 and wherein the projection is placed behind the heel 4 via a strap 17, respectively, are illustrated. The projection 15 may also be attached to the pressure point sleep garment 1 via one or more straps 17 secured to the upper portion 12 of the sock pressure point sleep garment 1. The one or more straps 17 allow the projection 15 to be moved into various positions. For example, the projection 15 may be positioned under the wearer's heel 4 when the wearer is lying down (as illustrated in FIG. 4) or pulled back behind the heel 4 when the wearer needs to walk (as illustrated in FIG. 5), thereby allowing the wearer to walk without the projection 15 being located on the bottom of the foot 3. In addition, the one or more straps 17 allow the projection 15 to be tightened or loosened against the heel 4 of the wearer via at least one length adjusting means, such as a slide 18.

Figure 7:
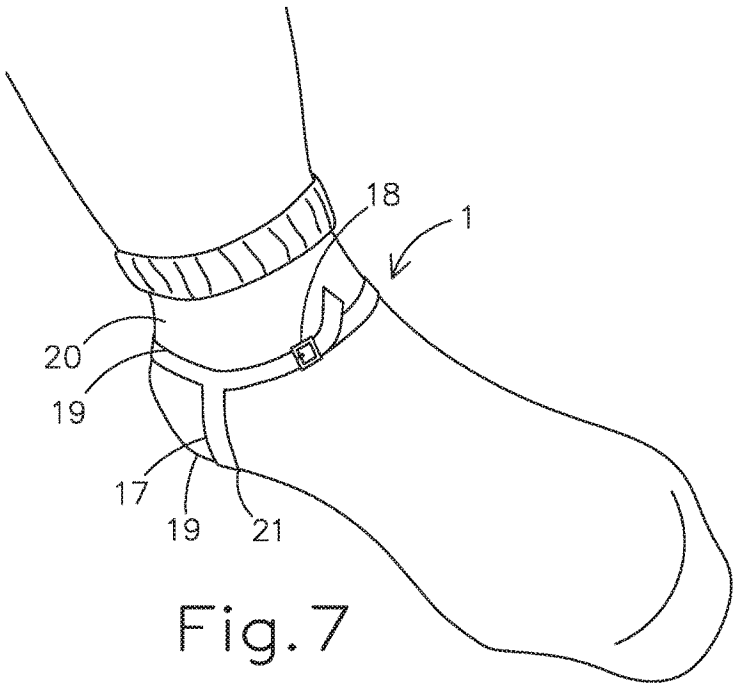
FIG. 7 is a top perspective view of a pressure point sleep garment being worn on a foot via straps.
Figure 8:
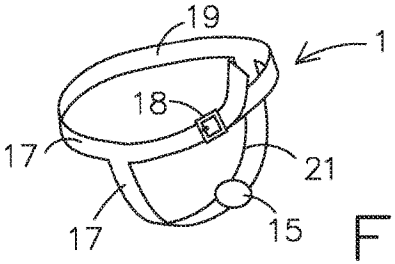
FIG. 8 is a perspective front view of an unworn pressure point sleep garment of the present invention that attaches to a foot via straps.
Figure 6:
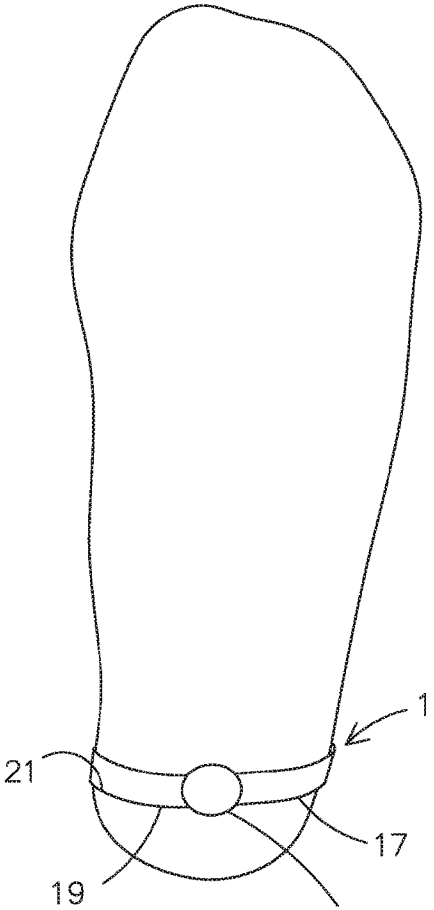
FIG. 6 is a bottom view of a pressure point sleep garment being worn on a foot via straps.

With reference to FIGS. 6-8, a bottom view and top perspective, respectively, of a pressure point sleep garment 1 being worn on a foot 3 and a front perspective view of an unworn pressure point sleep garment 1 of the present invention are illustrated. The projection 15 may be secured to one or more straps 17 that are worn without a sock 5, under a sock 5 and/or over a sock 5. The one or more straps 17 preferably creates an ankle strap 19 that encircles the ankle 20 of the wearer's foot 3 and a heel strap 21 that extends downward under the heel 4 of the wearer's foot 3 and holds the projection 14 against the heel 4 and the shimien pressure point 2. In addition, the one or more straps 17 allow the projection 15 to be tightened or loosened against the heel 4 of the wearer via at least one length adjusting means, such as a slide 18.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A pressure point sleep garment for applying a constant concentrated pressure to a heel of an individual's foot comprising:

a tubular-shaped sock having an interior surface, an exterior surface, a toe, a heel, an arch, a bottom surface, a top surface, an upper portion and a cuff; and a projection attached to the sock via at least one strap that loops around the heel of the sock so that when pressure point sleep garment is stretched over the foot, the projection applies pressure to the heel of the foot.

2. The pressure point sleep garment of claim 1 wherein:

said projection is spherically-shaped.

3. The pressure point sleep garment of claim 1 further comprising:

a non-slip material located on the cuff of the sock.

4. The pressure point sleep garment of claim 1 further wherein:

said cuff is an elastic cuff.

5. The pressure point sleep garment of claim 1 further comprising:

an adjustable strap in the cuff used to tighten the cuff.

6. The pressure point sleep garment of claim 1 further comprising:

at least one slide located on the at least one strap.

* * * * *